US009583859B2

(12) United States Patent
Endo et al.

(10) Patent No.: US 9,583,859 B2
(45) Date of Patent: Feb. 28, 2017

(54) CONDUCTIVE FEMALE TERMINAL, CONNECTOR AND METHOD OF MANUFACTURING CONDUCTIVE FEMALE TERMINAL

(71) Applicant: Dai-ichi Seiko Co., Ltd., Kyoto-shi, Kyoto (JP)

(72) Inventors: Takayoshi Endo, Shizuoka (JP); Kenya Ando, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/135,439

(22) Filed: Apr. 21, 2016

(65) Prior Publication Data

US 2016/0322728 A1 Nov. 3, 2016

(30) Foreign Application Priority Data

Apr. 30, 2015 (JP) ..... 2015-093229

(51) Int. Cl.

| | |
|---|---|
| ***H01R 13/42*** | (2006.01) |
| ***H01R 13/422*** | (2006.01) |
| ***H01R 13/11*** | (2006.01) |
| ***H01R 13/187*** | (2006.01) |
| ***H01R 43/16*** | (2006.01) |
| ***H01R 13/52*** | (2006.01) |

(52) U.S. Cl.

CPC ..... *H01R 13/4223* (2013.01); *H01R 13/11* (2013.01); *H01R 13/187* (2013.01); *H01R 13/5208* (2013.01); *H01R 43/16* (2013.01)

(58) Field of Classification Search

CPC ..... H01R 13/4223

See application file for complete search history.

(56) References Cited

U.S. PATENT DOCUMENTS

| | | | | |
|---|---|---|---|---|
| 5,609,505 | A * | 3/1997 | Endo | H01R 13/03 439/886 |
| 6,336,979 | B1 * | 1/2002 | Sugawara | C22F 1/02 148/282 |
| 6,375,501 | B1 * | 4/2002 | Kojima | H01R 13/4223 439/382 |
| 2007/0105457 | A1 * | 5/2007 | Machida | H01R 13/4367 439/852 |

(Continued)

FOREIGN PATENT DOCUMENTS

| | | |
|---|---|---|
| JP | 10247542 | 9/1998 |
| JP | 2003331972 | 11/2003 |
| JP | 2014519695 A | 8/2014 |

*Primary Examiner* — James Harvey

(74) *Attorney, Agent, or Firm* — Howard & Howard Attorneys PLLC

(57) ABSTRACT

A conductive female terminal includes a cylindrical main body formed of a conductor, and formed with a first opening in which a male terminal is to be inserted, and a first protrusion formed of a conductor, and formed so as to protrude from the main body in a direction becoming apart from an axial center of the main body. The first protrusion includes a first inclined portion inclined so as to approach the axial center of the main body toward the first opening, a first plane portion extending from the first inclined portion toward the first opening, and disposed so as to overlap with an outer face of the main body, and a first interconnecting portion that interconnects the first inclined portion with the main body.

16 Claims, 13 Drawing Sheets

(56) References Cited

U.S. PATENT DOCUMENTS

| | | | | |
|---|---|---|---|---|
| 2010/0273366 | A1* | 10/2010 | Okano | H01R 4/185 439/877 |
| 2013/0224983 | A1* | 8/2013 | Matsumura | H01R 13/113 439/345 |
| 2014/0256196 | A1* | 9/2014 | Suzuki | H01R 13/4223 439/746 |
| 2015/0037995 | A1* | 2/2015 | Saitou | H01R 13/4223 439/310 |
| 2015/0364857 | A1* | 12/2015 | Endo | H01R 13/05 439/733.1 |
| 2016/0322728 | A1* | 11/2016 | Endo | H01R 13/4223 |

* cited by examiner

10u

CONDUCTIVE FEMALE TERMINAL, CONNECTOR AND METHOD OF MANUFACTURING CONDUCTIVE FEMALE TERMINAL

CROSS-REFERENCE TO RELATED APPLICATION

This application claims the benefit of Japanese Patent Application No. 2015-093229, filed on Apr. 30, 2015, the entire disclosure of which is incorporated by reference herein.

FIELD

This application relates to a conductive female terminal, a connector and method of manufacturing the conductive female terminal.

BACKGROUND

As for conductive terminals utilized for a water-proof connector that includes a water-proof mat seal, various technologies have been conventionally developed. For example, a receptacle contact that formed by performing a bending work, and the like, on a sheet metal having undergone a punching work already is disclosed in National Patent Publication No. 2012/173961.

The receptacle contact showed in that patent publication includes a structure where many burr edges are exposed on the outside of the receptacle contact. Hence, when the receptacle contact is inserted in the cavity of the housing, the burr edge may be trapped in the mat seal and so on that the housing includes, easily resulting in any damage to a water-proofing member such as the mat seal.

In addition, the receptacle contact includes an elastic contact arm that applies pressure to a pin contact. When the pin contact is inserted in the receptacle contact, the upper wall of the receptacle contact may be deformed by elastic force originating from the elastic contact arm. The deformation of the upper wall decreases the contact load to the pin contact, and thus the electrical connection reliability may decrease.

SUMMARY

This application claims the benefit of Japanese Patent Application No. 2015-093229, filed on Apr. 30, 2015, the entire disclosure of which is incorporated by reference herein. Hence, the purpose of the present disclosure is to provide a conductive terminal which is capable of suppressing damage to a mat seal when the conductive terminal is inserted in the housing, and which is not likely to decrease the electrical connection reliability.

A conductive female terminal according to an aspect of the present disclosure includes:

a cylindrical main body formed of a conductor, and formed with a first opening in which a male terminal is to be inserted; and a first protrusion formed of a conductor, and formed so as to protrude from the main body in a direction becoming apart from an axial center of the main body, in which the first protrusion includes:

a first inclined portion inclined so as to approach the axial center of the main body toward the first opening;

a first plane portion extending from the first inclined portion toward the first opening, and disposed so as to overlap with an outer face of the main body; and a first interconnecting portion that interconnects the first inclined portion with the main body.

In this case, it is desirable that the first protrusion should further include a first abutting portion extending from an end of the first inclined portion in the direction approaching the axial center of the main body, and abutting the outer face.

In addition, it is desirable that the conductive female terminal should further be formed with a second opening located on the opposite side to the first opening, and further include a second protrusion formed, at the second opening side relative to the first protrusion, so as to protrude from the main body in the direction becoming apart from the axial center of the main body, in which the second protrusion includes:

a second inclined portion inclined so ad to approach the axial center of the main body toward the second opening;

a second plane portion extending from the second inclined portion toward the second opening, and disposed so as to overlap with the outer face; and a second interconnecting portion that interconnects the second inclined portion with the main body.

Still further, it is desirable that the second protrusion should further include a second abutting portion extending from the second inclined portion in the direction approaching the axial center of the main body, and abutting the outer face.

Yet still further, it is desirable that the conductive female terminal should further include a connection portion formed of a conductor, extending from an end of the main body at the second opening side, and connected with a wire.

A connector according to another aspect of the present disclosure include:

a housing formed with a plurality of terminal housing rooms disposed in a matrix, and comprises a plurality of lances each protruding in the terminal housing rooms; and a plurality of the conductive female terminals of the above aspect laid out in a matrix; and the conductive female terminals are each inserted in the terminal housing rooms, and each fixed in the terminal housing rooms because the first protrusion of the conductive female terminal is engaged with the lance.

In this case, it is desirable to perform a drawing work on a sheet material to form the main body, thereby forming the first and second inclined portions and the first and second plane portions.

A method of manufacturing a conductive female terminal according to the other aspect of the present disclosure includes:

preparing a basal plate that comprises a conductive sheet and a conductive portion provided at a side of the conductive sheet so as to extend from the side thereof;

shaping the conductive portion in a concave shape;

shaping the conductive sheet cylindrically so as to cause the conductive portion shaped concavely to extend in a circumferential direction of the conductive sheet shaped cylindrically; and providing the conductive portion shaped concavely so as to be putted on the conductive sheet shaped cylindrically.

In this case, it is desirable that the conductive female terminal manufacturing method should further include: making a portion of the conductive portion shaped concavely to abut the conductive sheet shaped cylindrically.

BRIEF DESCRIPTION OF THE DRAWINGS

A more complete understanding of this application can be obtained when the following detailed description is considered in conjunction with the following drawings, in which.

DETAILED DESCRIPTION

Figure 1:
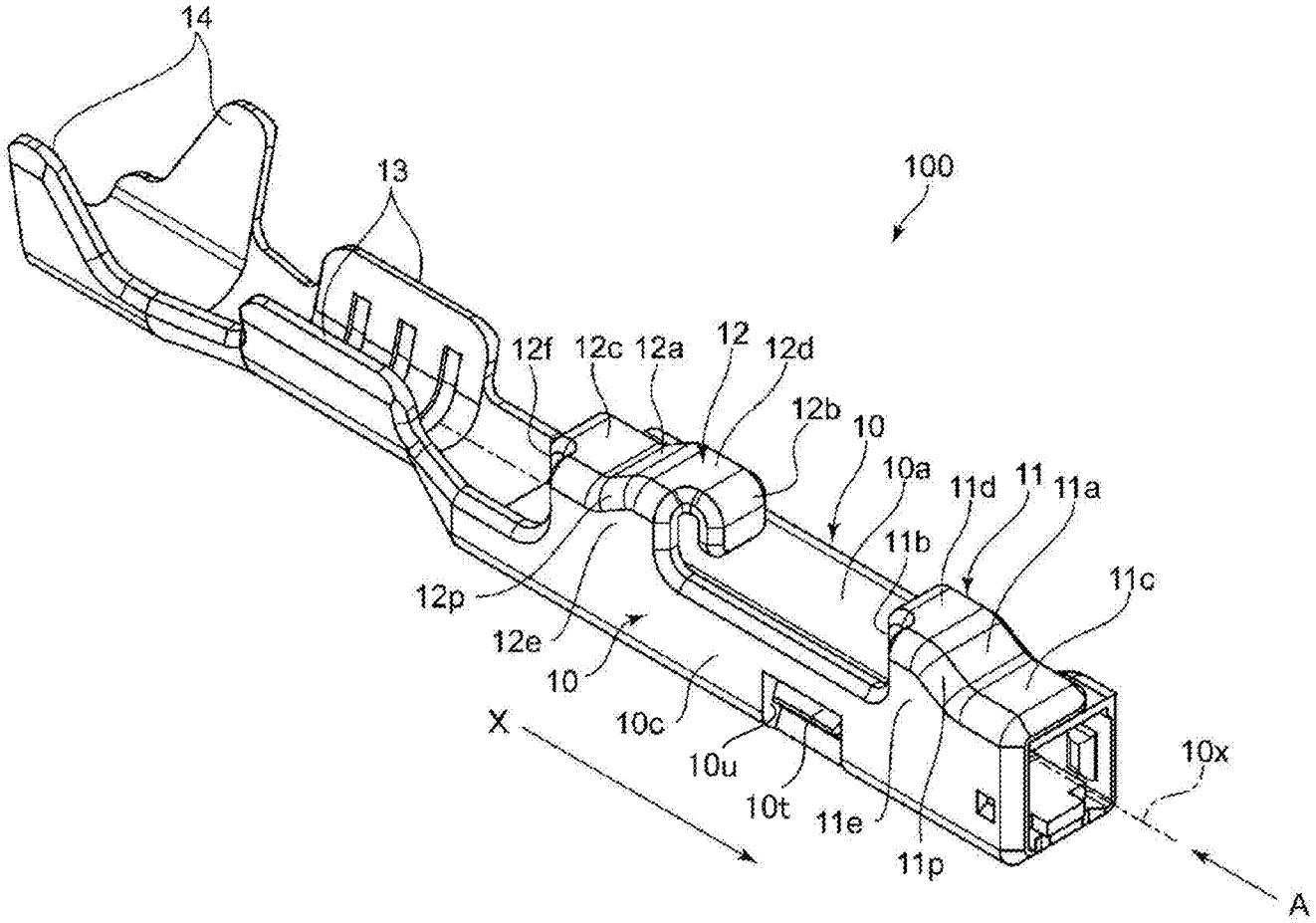
FIG. 1 is a perspective view of a conductive terminal according to an embodiment of the present disclosure.

A conductive terminal (conductive female terminal) 100 and an electrical connector 500 (see FIGS. 11 and 12) including the conductive terminals 100 according to an embodiment of the present disclosure will be explained below with reference to FIGS. 1-13. The conductive terminal 100 is a component that is to be inserted to a cylindrical terminal housing room 40 formed in the insulative housing 400 (see FIGS. 8-10). The conductive terminal 100 is inserted from a back face 400*b* side toward a front face 400*a* side of the housing 400, in a manufacturing process of an electrical connector 500, as illustrated in FIG. 1.

The conductive terminal 100 includes a rectangular cylindrical sheath (main body) 10, a core wire crimping portion 13 and a cable holding portion 14, as showed in FIGS. 1 to 5. Note, in the following explanation, "inserting direction X" and "opposite direction to the inserting direction X" are simply referred to as "forward" and "backward".

The sheath 10 is a component to which a male contact is to be inserted, and includes a ceiling wall 10*a*, a bottom wall 10*b*, and side walls 10*c*, 10*d*, as showed in FIGS. 1 to 3 and 5. The ceiling wall 10*a*, the bottom wall 10*b*, and the side walls 10*c*,10*d* are formed in a rectangular cylindrical shape as a whole, forming a first opening at one end to which the male contact is to be inserted, and a second opening at another end which is interconnected and opposite to the first opening. Note, the first opening is the forward opening, while the second opening is a backward opening.

Figure 5:
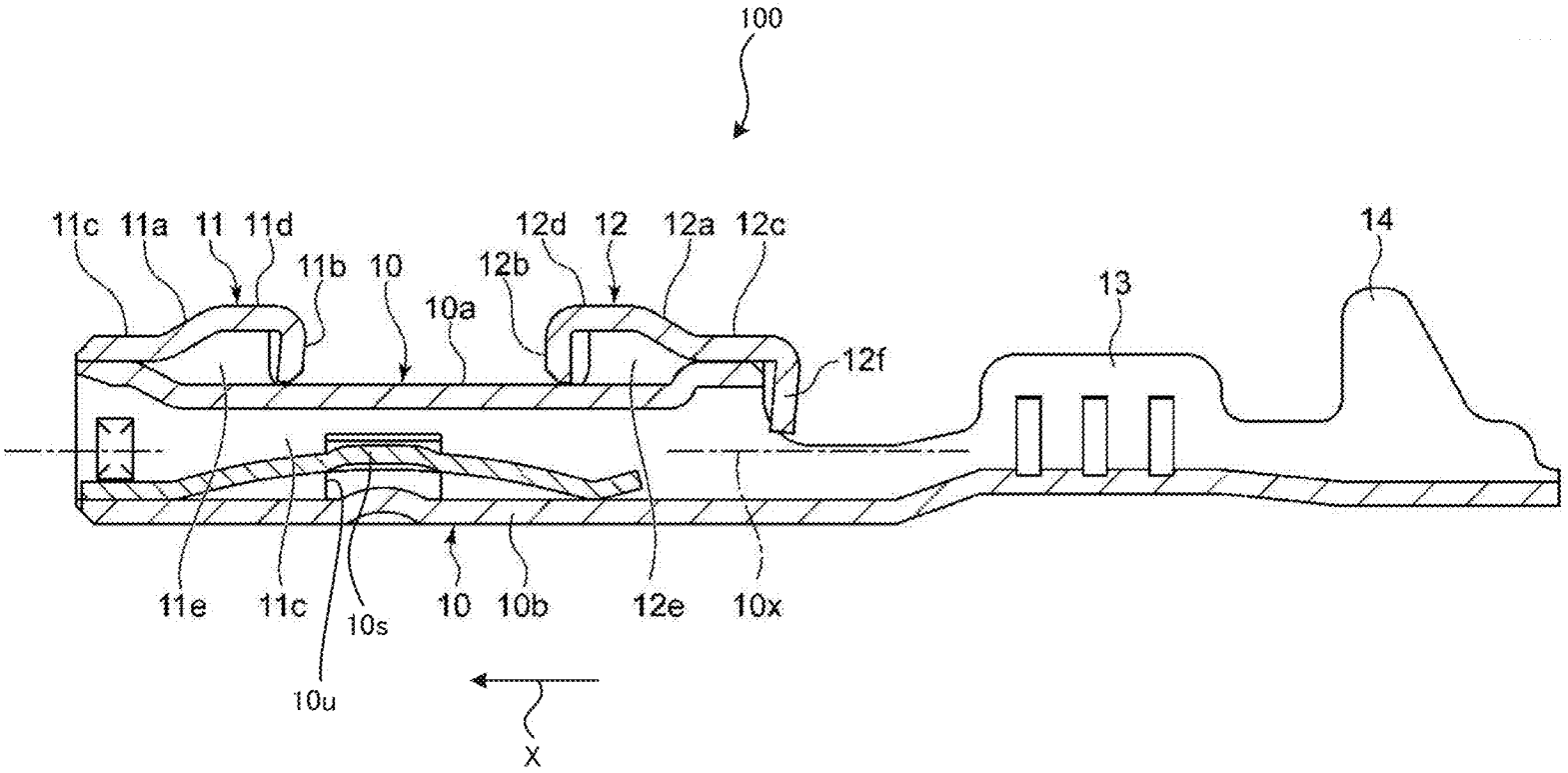
FIG. 5 is a cross-sectional view taken along a line C-C in FIG. 3.

As illustrated in FIG. 5, a plate spring 10*s* is disposed in the sheath 10. The plate spring 10*s* interconnects to the male terminal inserted to the sheath 10, and makes the conductive terminal 100 electrically connect to the male terminal. The plate spring 10*s* includes wing portions 10*t* at both ends. The wing portions 10*t* is each inserted to support openings 10*u* each formed on the side walls 10*c*, 10*d*.

The sheath 10 further includes a first engage portion (first protrusion) 11, and a second engage portion (second protrusion) 12.

The first engage portion 11 is a component that engages a lance 41 (see FIGS. 10 and 12) provided in the terminal housing room 40. As showed in FIGS. 1, 2, 4 and 5, the first engage portion 11 is disposed at the forward end of the sheath 10, and protrudes from the ceiling wall 10*a* in a direction becoming apart from an axial center 10*x* of the sheath 10. In other words, the first engage portion 11 comprises a plate having a smooth convex shape without exposed burr edges and is disposed at the forward end of the sheath 10.

Figure 10:
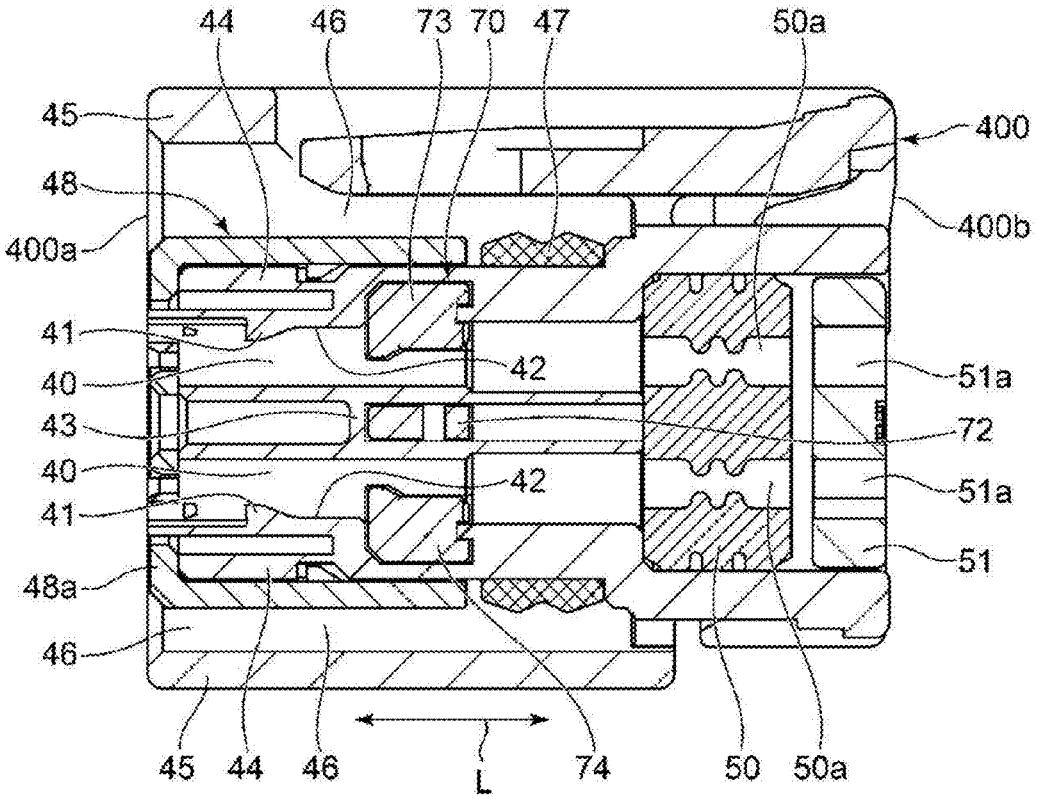
FIG. 10 is a cross-sectional view taken along a line E-E in FIG. 9.
Figure 11:
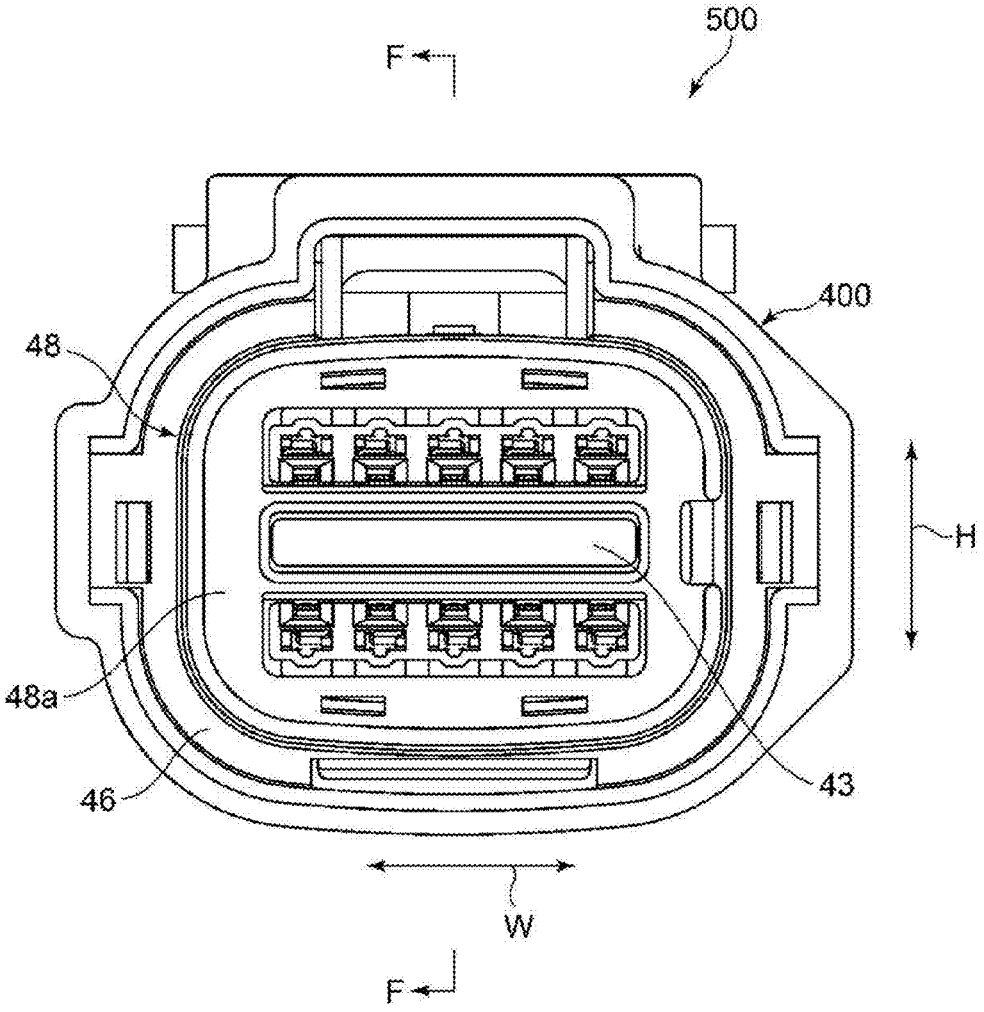
FIG. 11 is a front view of the housing in which the conductive terminals illustrated in FIG. 1 are inserted (an electrical connector)
Figure 12:
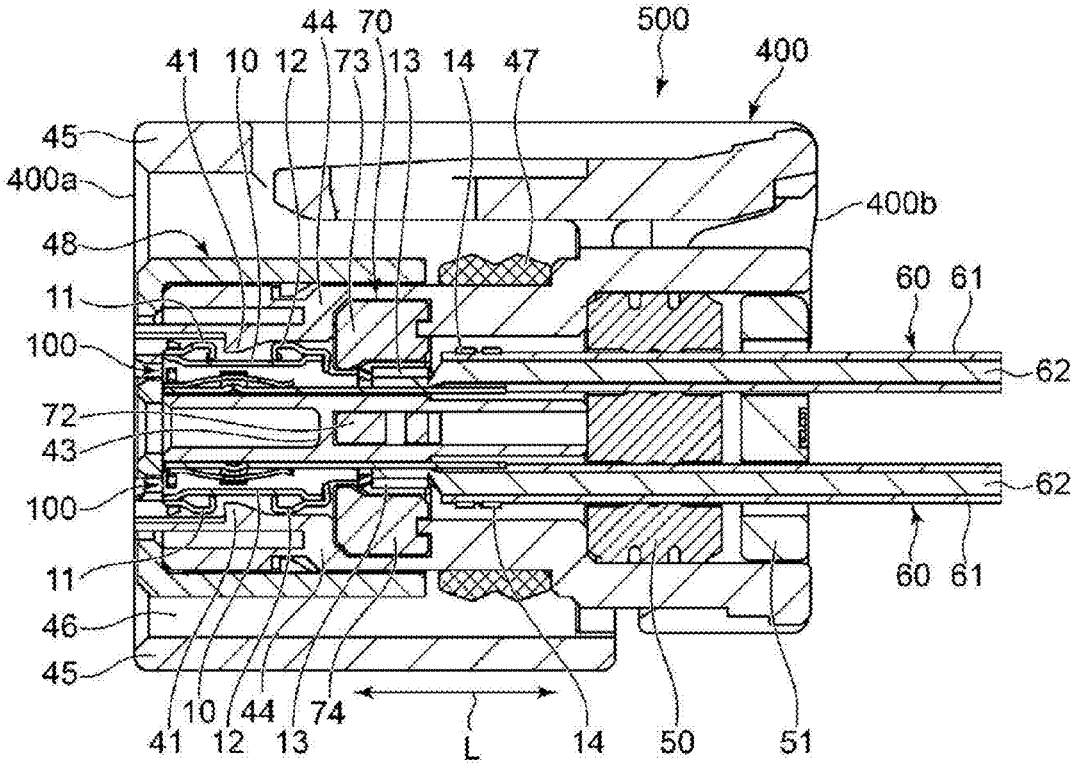
FIG. 12 is a cross-sectional view of the electrical connector taken along a line F-F in FIG. 11.

The second engage portion 12 is a component that abuts with an inner circumference 42 of the terminal housing room 40 of the housing 400 (a portion located at the back face 400*b* side relative to the lance 41, see FIGS. 10 and 12) As showed in FIGS. 1, 2, 4 and 5, the second engage portion 12 is disposed at the back forward end of the sheath 10, and protrudes from the ceiling wall 10*a* in the direction becoming apart from the axial center 10*x* of the sheath 10. In other words, the second engage portion 12 comprises a plate having a smooth convex shape without exposed burr edges and is disposed at the back forward end of the sheath 10.

As showed in FIGS. 1 to 5, the first engage portion 11 includes, an inclined portion (first inclined portion) 11*a* that is inclined so as to approach the axial center 10*x* of the sheath 10 and toward the first opening, and a plane portion (first plane portion) 11*c* which extends from the inclined portion 11*a* toward the first opening, and which overlaps with the outer face of the ceiling wall 10*a* of the sheath 10. In addition, as shown in FIG. 1, the first engage portion 11 also includes a top portion 11*d* provided at an edge of the inclined portion 11*a* so as to be in parallel with the ceiling wall 10*a*, and an abutting portion (first abutting portion) 11*b* which is provided at an edge of the top portion 11*d* so as to extend toward and approach the axial center 10*x* of the sheath 10. A lower end portion (closest portion to the axial center 10*x*) of the abutting portion 11*b* abuts the outer face of the ceiling wall 10*a* of the sheath 10. In addition, the first engage portion 11 includes an interconnecting portion (first interconnecting portion) 11*e* that interconnects the top portion 11*d*, the inclined portion 11*a*, the plane portion 11*c* with the side wall 10*c* of the sheath 10, as shown in FIG. 1.

The second engage portion 12 includes, an inclined portion (second inclined portion) 12*a* that is inclined so as to approach the axial center 10*x* of the sheath 10 and toward the second opening, and a plane portion (second plane portion) 12*c* which extends from the inclined portion 12*a* toward the second opening, and which overlaps with the outer face of the ceiling wall 10*a* of the sheath 10. In addition, the second engage portion 12 also includes, at the edge of the inclined portion 12*a*, a top portion 12*d* provided so as to be in parallel with the ceiling wall 10*a*, and an abutting portion (second abutting portion) 12*b* which is provided, at the edge of the top portion 12*d*, so as to extend toward and approach the axial center 10*x* of the sheath 10. The lower end portion (closest portion to the axial center 10*x*) of the abutting portion 12*b* abuts the outer face of the ceiling wall 10*a* of the sheath 10. A stopper portion 12*f* which extends downwardly toward the axial center 10*x* of the sheath 10 is continuously provided at the edge of the plane portion 12*c*. Still further, as shown in FIG. 1, the second engage portion 12 includes an interconnecting portion (second connecting portion) 12*e* that interconnects the top portion 12*d*, the inclined portion 12*a*, the plane portion 12*c* with the side wall 10*c* of the sheath 10.

Provided at the backward side of the conductive terminal 100 are the core wire crimping portion (connection portion) 13. A core wire 62 revealed from an insulating coating 61 of a cable (wire) 60 for sending electrical signals is disposed on the core wire crimping portion 13. The crimping portion 13 fastens and is electrically connected to the core wire 62 by crimping the core wire 62. The cable holding portion 14 is provided to interconnect the backward edge of the core wire crimping portion 13. The cable holding portion 14 holds the insulating coating 61 of the cable 60 by crimping the insulating coating 61.

As showed in FIGS. 1 to 5, the top portion 11*d*, the inclined portion 11*a*, the plane potion 11*c* and the interconnecting portion 12*e* are formed of one conductive plate and continuously formed, resulting in that any burr edges are not exposed on the outer face of the conductive terminal 100.

Next, a manufacturing process of the conductive terminal 100 including the components described above is explained below with reference to FIGS. 6 and 7. The conductive terminal 100 is formed by performing a bending work and a drawing work on a sheet metal material 900 (basal plate) having undergone a punching work already illustrated in FIG. 6.

Figure 6:
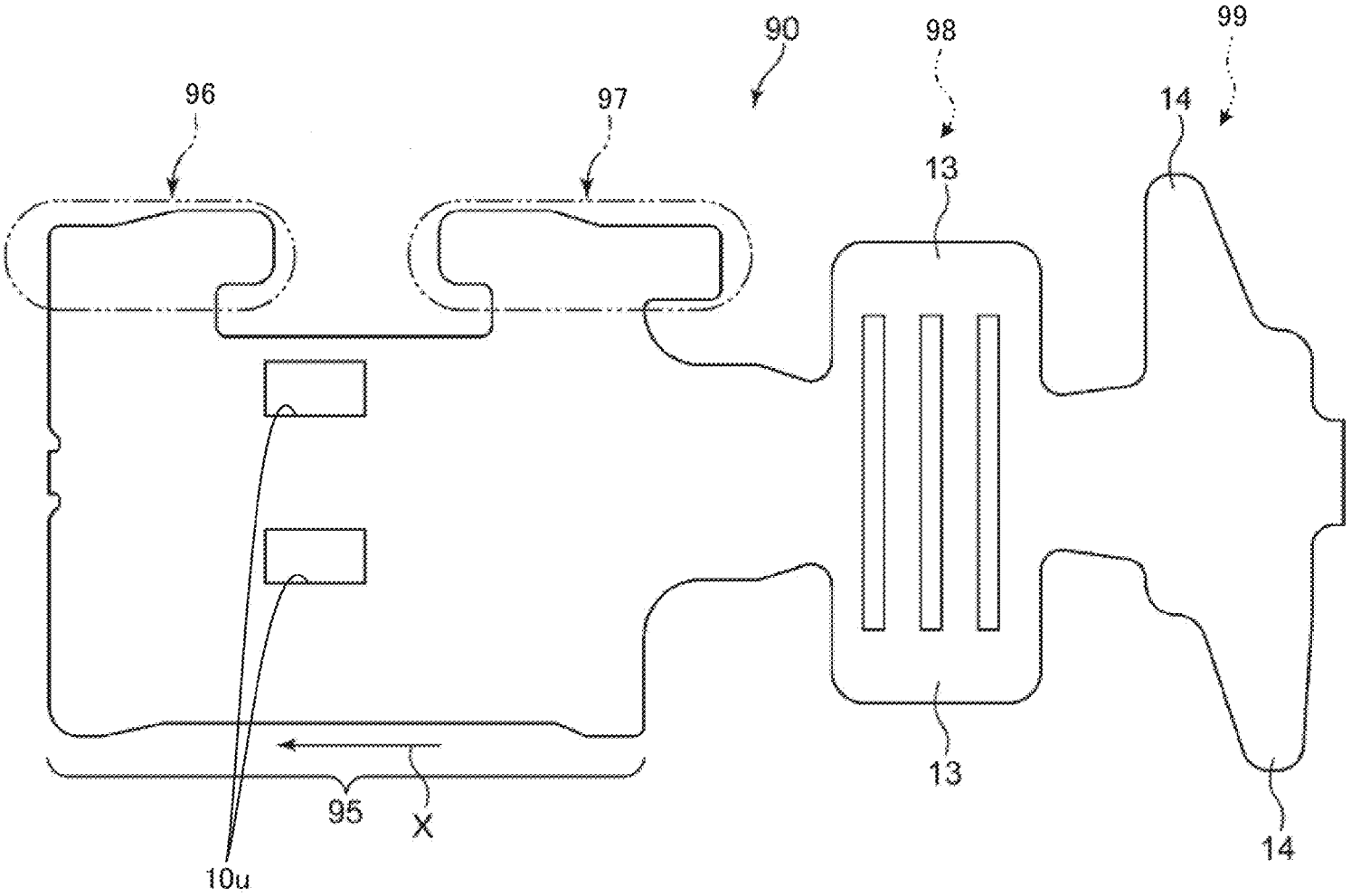
FIG. 6 is a diagram illustrating a sheet metal material that is a base material of the conductive terminal illustrated in FIG. 1.

First of all, the sheet metal material 90 of which shape is as illustrated in FIG. 6 is prepared by performing a punching work on a sheet metal. The sheet metal material 90 includes a sheath formation area (conductive sheet) 95 to be formed into the sheath 10, a small portion (conductive portion) 96 to be formed into the first engage portion 11, a small portion 97 to be formed into the second engage portion 12, an area 98 to be formed into the core wire crimping portion 13, and an area 99 to be formed into the cable holding portion 14.

Next, by bending and drawing works, the small portions 96 and 97 are formed into concave shapes corresponding to the first engage portion 11 and second engage portion 12, respectively. The conductive sheet 95 is processed into a cylindrical shape to form the sheath 10. The order to form the first engage portion 11, second engage portion 12 and the sheath 10 is not limited. Thereby, a structure in which the small portions 96 and 97 shaped concavely extend in a circumferential direction of the conductive sheet 95 shaped cylindrically, is obtained. Then, the small portions 96 and 97 shaped concavely disposed so as to cover the ceiling wall 10*a* of the sheath 10. At that time, portions 11*b* and 12*b* of the small portions 96 and 97 formed into concave shapes are made to abut the ceiling wall 10*a*.

Figure 7:
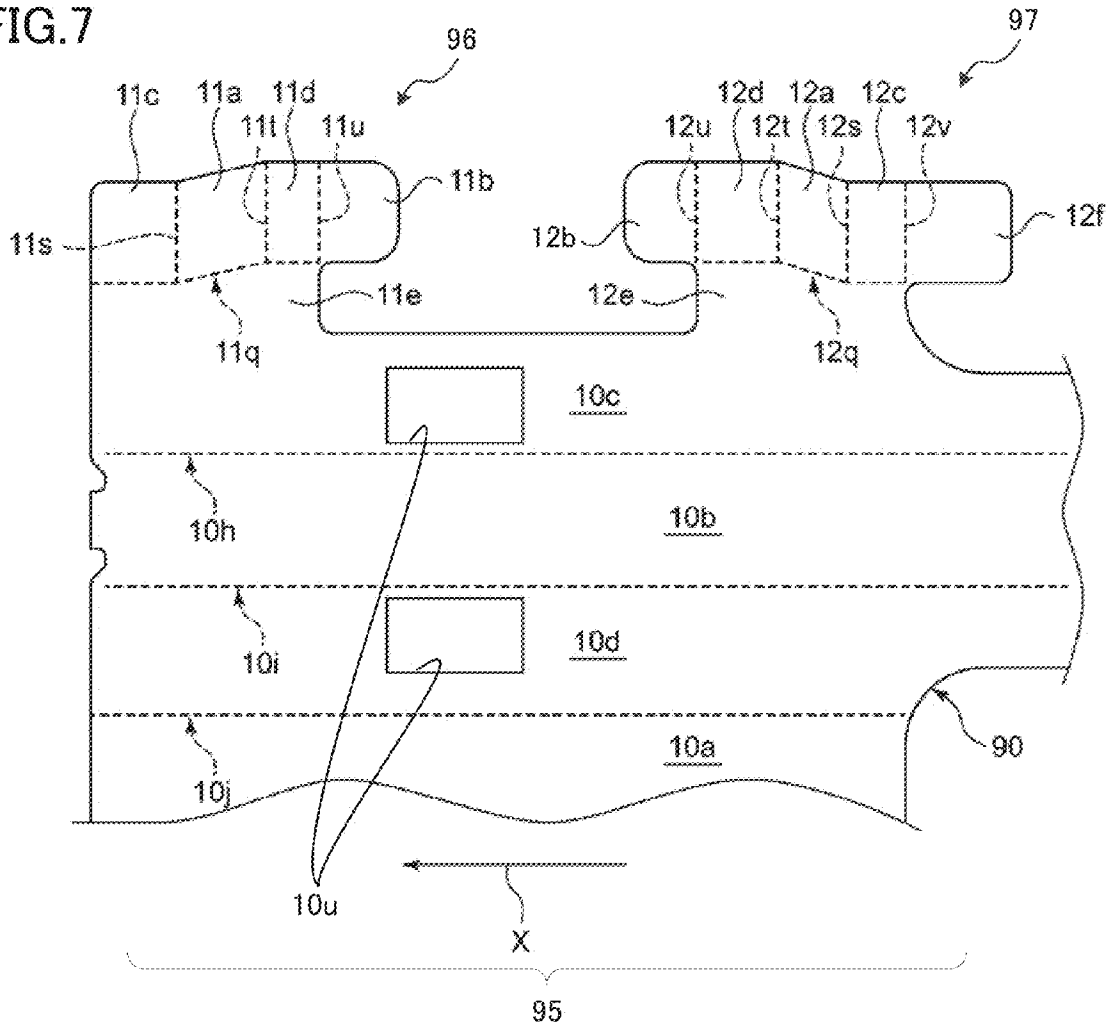
FIG. 7 is a partial enlarged view of the sheet metal material illustrated in FIG. 6.

One example will be explained. First, the metal sheet 90 illustrated in FIG. 6 is prepared. Next, a bending work on the sheet metal material 90 illustrated in FIG. 7 is performed so as to accomplish valley folding at fold lines 10*h*, 10*i* and 10*j*, resulting in the rectangular cylindrical sheath 10 including the ceiling wall 10*a*, the bottom wall 10*b* and the side walls 10*c* and 10*d*. Note, the term "valley fold" is an expression that is based on the surface of FIG. 7.

Figure 2:
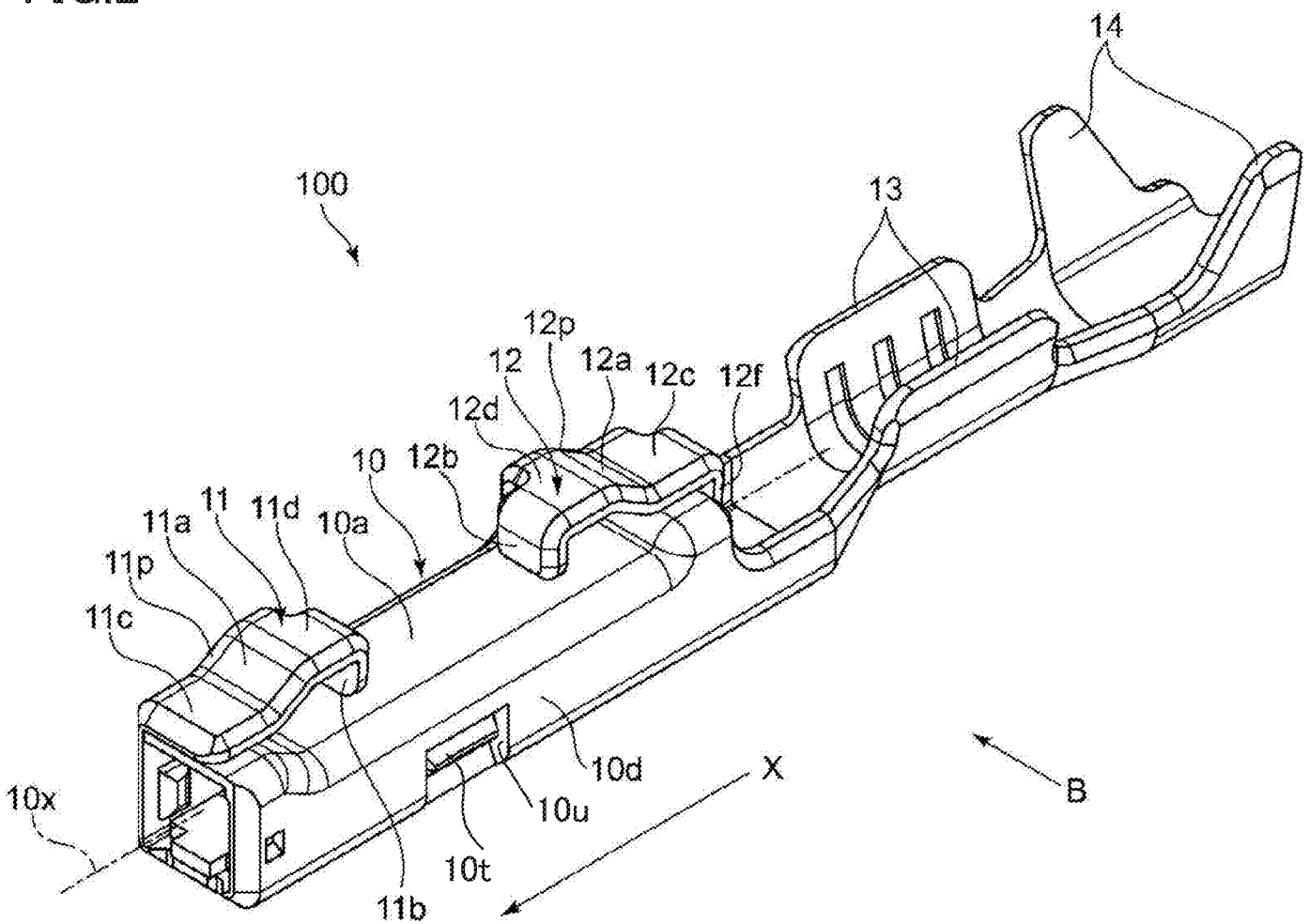
FIG. 2 is another perspective view of the conductive terminal illustrated in FIG. 1.
Figure 3:
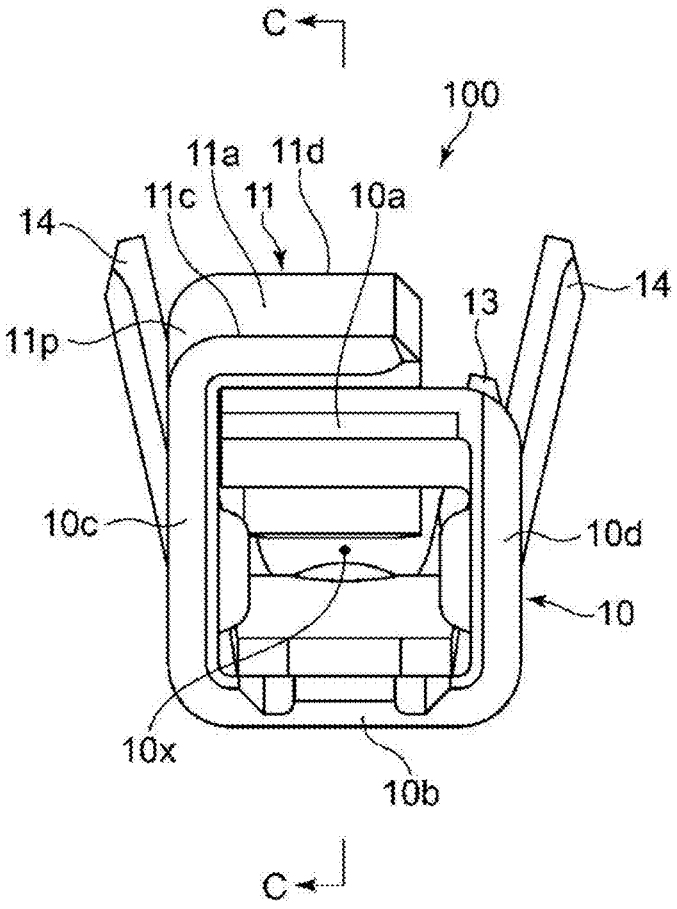
FIG. 3 is a front view of the conductive terminal as viewed in the direction of an arrow A in FIG. 1.
Figure 4:
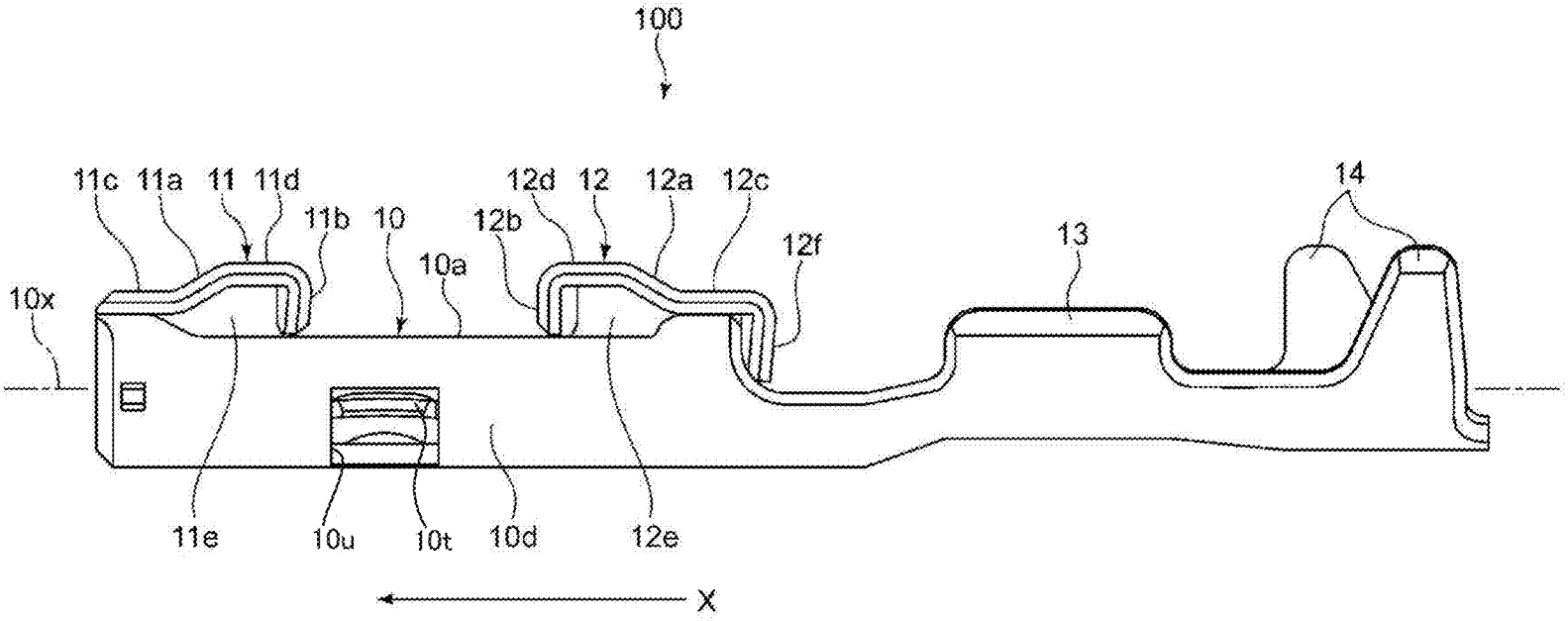
FIG. 4 is a side view of the conductive terminal as viewed in the direction of an arrow B in FIG. 2.

In this case, before performing a bending work on the sheet metal material 90 along the hold lines 10*h*, 10*i*, and 10*j*, the plate spring 10*s* is disposed on the bottom wall 10*b* for the purpose of disposing the spring 10*s* illustrated in FIG. 5 on the sheath 10. In addition, when performing the bending work on the sheet metal material 90, the wing portions 10*t* each protrudes at the both end of the plate spring 10*s* are inserted to the support opening 10*u*, as illustrated in FIGS. 1, 2, 4.

Returning to FIG. 7, next, a drawing work so as to accomplish a valley folding at a fold line 11*q* is performed, and a bending work so as to accomplish a valley folding at fold lines 11*t*, 11*u* and a mountain folding at a fold line 11*s* is performed. Hence, the plane portion 11*c*, the inclined portion 11*a*, the top portion 11*d* and the interconnecting portion 11*e* are continuously formed in a seamless manner. Note, the term "mountain fold" is an expression that is based on the surface of FIG. 7.

In the same way, concerning the small portion 97, a drawing work so as to accomplish a valley folding at a fold line 12*q* is performed, and a bending work so as to accomplish a valley folding at fold lines 12*u*, 12*t*, 12*v* and a mountain folding at a fold line 12*s* is performed on the sheath formation area 95. Hence, the stopper portion 12*f*, the plane portion 12*c*, the inclined portion 12*a*, the top portion 12*d* and the interconnecting portion 12*e* are continuously formed in a seamless manner.

Next, the lines 11*q* and 12*q* are further bended so that the first engaging portion 11 and the second engaging portions 12 cover the sheath 10 and the abutting portions 11*b* and 12*b* abut the ceiling wall 10*a* of the sheath 10.

In addition, each of the area 98, 99 is formed into the core wire crimping portion 13 and the cable holding portion 14 in the same way.

In other words, the conductive terminal 100 is produced by forming the sheath formation area 95 in a cylindrical shape, and performing a drawing work and a bending work on each of the small portion 96, 97 to be formed into the first engage portion 11 and the second engage portion 12.

Figure 8:
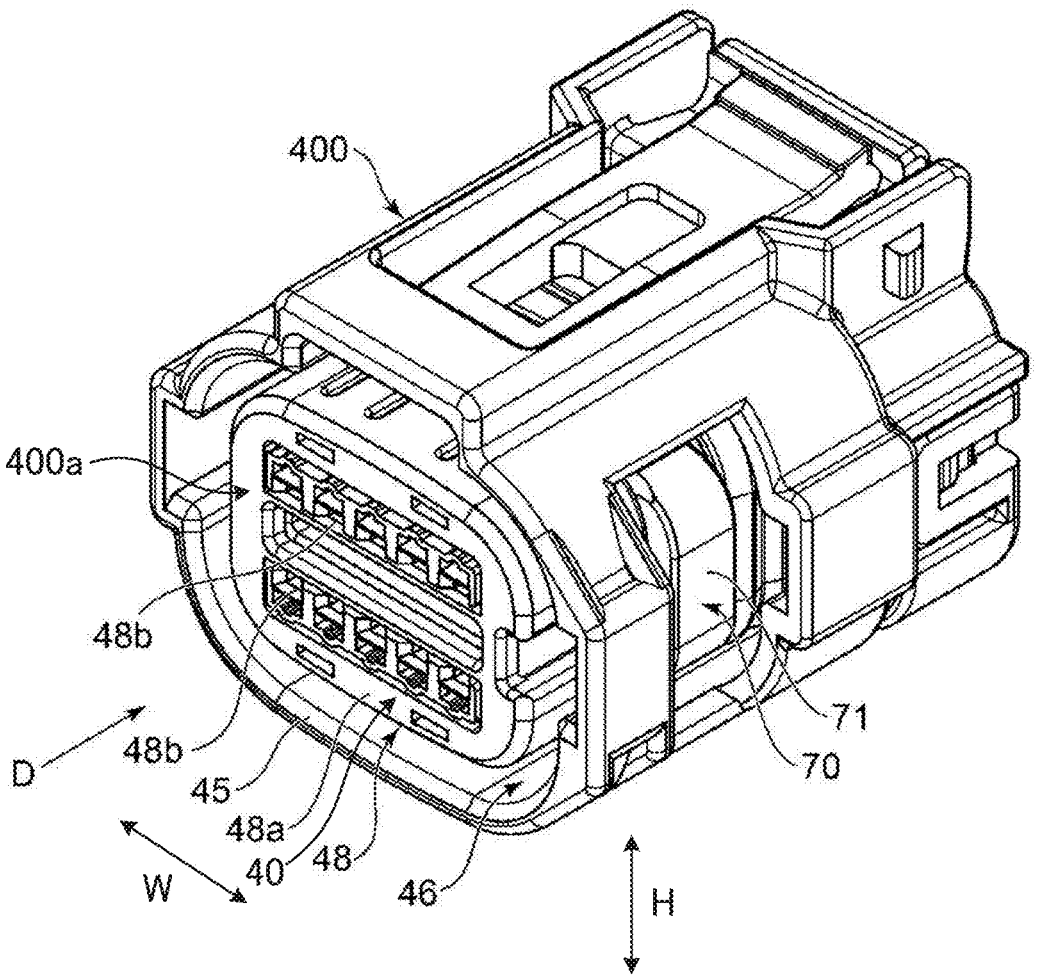
FIG. 8 is a perspective view of a housing in which the conductive terminal illustrated in FIG. 1 is to be inserted.
Figure 9:
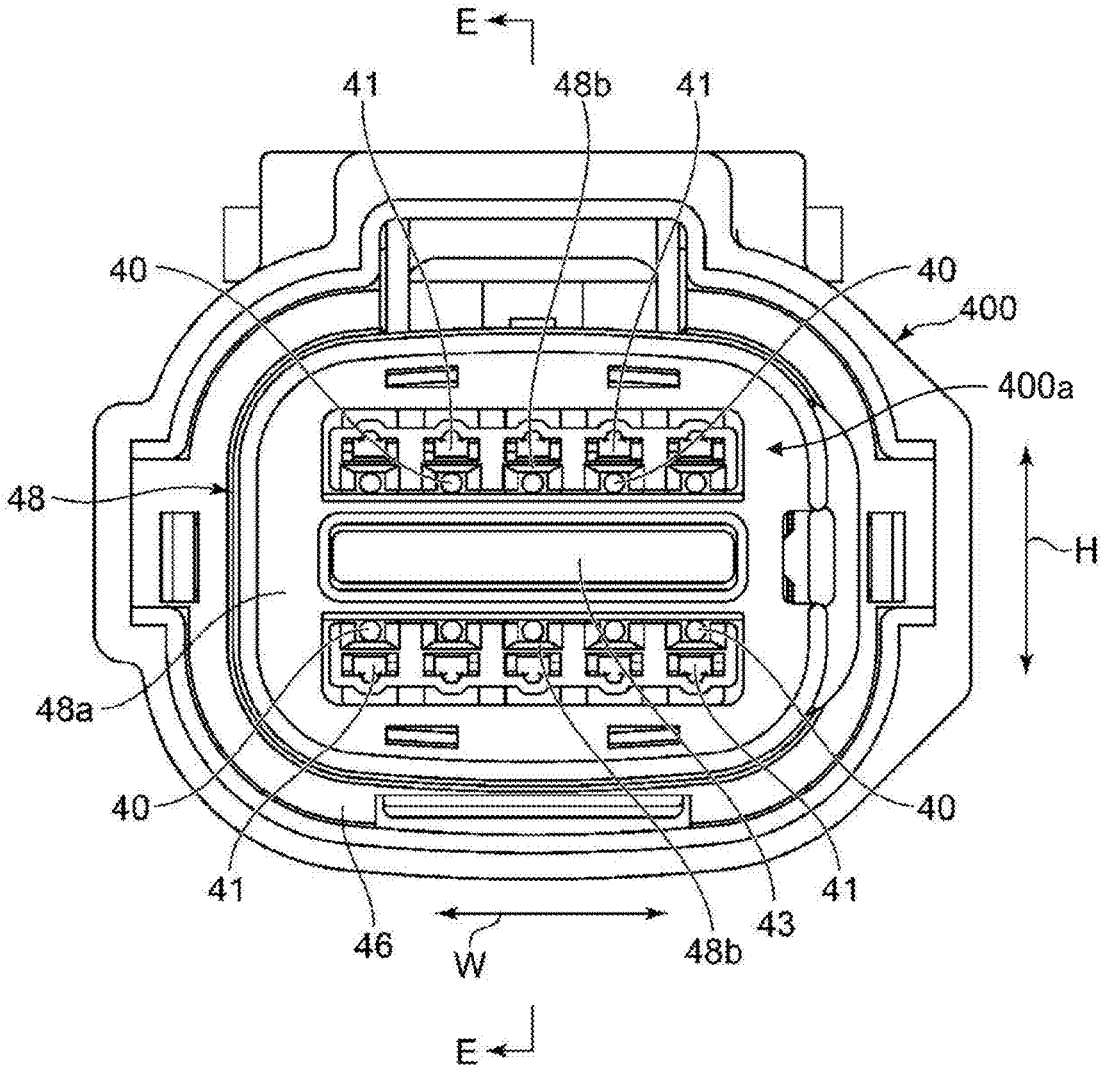
FIG. 9 is a front view of the housing as viewed in the direction of the arrow D in FIG. 8.

A plurality of the conductive terminals 100 are connected to the cables 60 and inserted to a plurality of terminal housing rooms 40 from the back face respectively, which are formed on the insulative housing 400 illustrated in FIGS. 8 to 10. Hence, a water-proof connector 500 of the present disclosure is formed. The housing 400 and the water-proof connector 500 are explained below.

As illustrated in FIGS. 9, 10, the plurality of the terminal housing rooms 40 provided in the housing 400 in a symmetrical layout which is across a partition wall 43 and in two rows in a height direction H and five columns in a widthwise direction W (in a matrix). In addition, a hollow 46 for accepting a part of an unillustrated housing of a counterpart connector to be connected with the water-proof connector 500 is formed between a peripheral wall 44 that is formed so as to encircle the surroundings of those terminal housing rooms 40 and an external wall 45 of the housing 400.

The lance 41 protruding to the terminal housing rooms 40 is formed on the each of the peripheral wall 44. The lance 41 is formed so as to protrude toward the terminal housing room 40. The peripheral wall 44 and the lance 41 are formed of an elastic material such as a resin, and are elastically deformable so as to be retracted from and returned to the terminal housing room 400.

As illustrated in FIG. 10, a front seal 47 is attached around the rear anchor of the peripheral wall 44, and a front holder 48 is attached to the peripheral wall 44 at the front face 400*a* side of the housing 400. The front seal 47 seals a gap between an outer face of the peripheral wall 44 and the housing of the unillustrated counterpart connector. The front holder 48 is a component that guides the male terminal to be inserted to the conductive terminal 100, and is slidable in a back-and-forth direction L of the housing 400. A front wall 48*a* of the front holder 48 is formed with a plurality of openings 48*b* aligned at the same intervals with the plurality of terminal housing rooms 40 respectively.

In addition, a retainer 70 that traverses the partition wall 43 and a part of the terminal housing room 40 in the widthwise direction W at the back face 400*b* side relative to the lance 41 is provided.

As illustrated in FIG. 8, the retainer 70 is capable of being inserted and removed in the widthwise direction W from the one side face (right side face) of the housing 400 toward the other side face (left side face) thereof. The retainer 70 is a member formed in a substantially E-shape entirely, includes a support portion 71 to be exposed at the side face (right side face) of the housing 400. In addition, the retainer 70 includes three stopper portions 72, 73, and 74 illustrated in FIGS. 10 and 12 extending in the orthogonal direction to the support portion 71.

As illustrated in FIG. 10, when the retainer 70 is inserted to the housing 400, the stopper portion 72 passes completely through the partition wall 43 of the housing 400 in the widthwise direction W, while each of the stopper portions 73, 74 passes completely through the peripheral wall 44 and a part of the terminal housing room 40. The stopper portion 72 is engaged with the partition wall 43, while each of the stopper portions 73, 74 abuts the partition wall 44 and the conductive terminal 100 inserted to the terminal housing room 40 respectively, thereby stably holding the conductive terminal 100.

Figure 13:
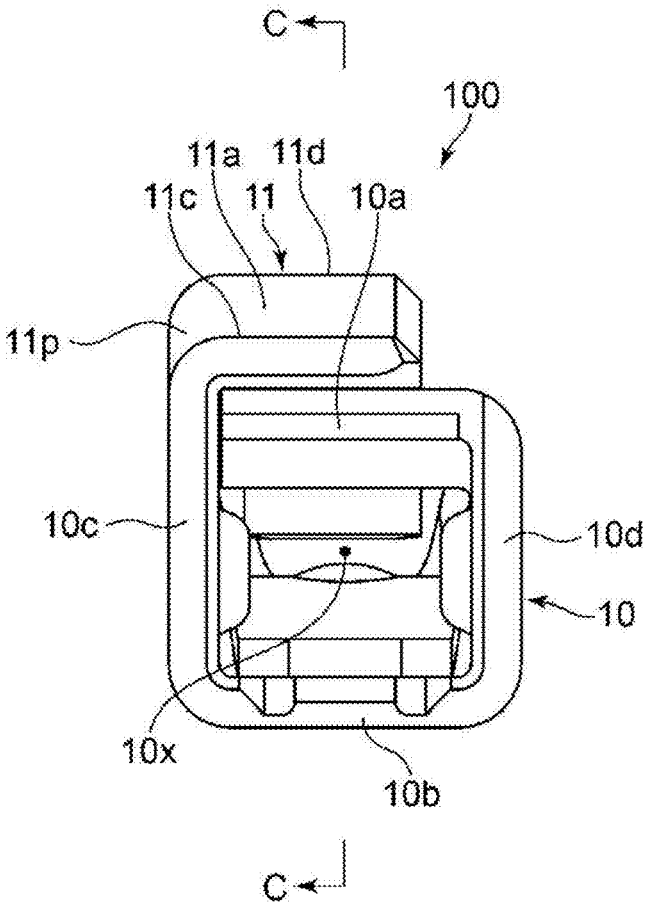
FIG. 13 is a front view of the conductive terminal after a cable is crimped therewith and as viewed from the direction of the arrow A in FIG. 1.

In addition, a mat seal 50 and a mat seal cover 51 both for water-proof performance are provided at the back face 400*b* side of the housing 400. The mat seal 50 seals the gap between the peripheral wall 44 and the cable 60. The mat seal cover 51 is disposed on the outside of the mat seal 50 and protects the mat seal 50. The mat seal 50 and the mat seal cover 51 are each formed with a plurality of through-holes 50*a*, 51*a* aligned at the same intervals with the plurality of terminal housing rooms 40 respectively. The conductive terminal 100 crimped with the cable 60 becomes a convex shape when viewed from the front, as is illustrated in FIG. 13. The open end shape of the through-hole 51*a* of the mat seal cover 51 is similar to the shape of the conductive terminal 100 when viewed from the front, and is formed in a convex shape slightly larger than that of the conductive terminal 100.

The procedure to set the conductive terminal 100 into the housing 400 having the structure explained above. First of all, the cable 60 illustrated in FIG. 12 is prepared. Next, the insulating coating 61 on the end of the cable 60 is removed to expose the core wire 62. The exposed core wire 62 is disposed on the core wire crimping portion 13, and the core wire crimping portion 13 is crimped with the exposed core wire 62 to apply pressure to the exposed core wire 62. Subsequently, the cable holding portion 14 is crimped with the insulating coating 61 to hold the insulating coating 61 of the cable 60. Hence, the cable 60 is set to each of the conductive terminal 100.

Then, the conductive terminal 100 is inserted in the through-hole 51*a* illustrated in FIG. 10 opened in the mat seal cover 51 at the back face side of the housing 400. This causes a structure illustrated in FIG. 12.

In the inserting procedure of the conductive terminal 100, the inclined portion 11*a* and the top portion 11*d* of the first engage portion 11 slidingly contact with the lance 41. This causes the lance 41 to be pushed up. After the first engage portion 11 passes completely through the lance 41, the lance 41 returns to the original position by its elastic force, and thus the lance 41 is caught between the first engage portion 11 and the second engage portion 12.

After the conductive terminals 100 are housed in all terminal housing rooms 40 of the housing 400, the retainer 70 is inserted in from the right side face of the housing 400 toward the left side face thereof. This causes each second engage portion 12 of the plurality of the conductive terminals 100 is stopped by the stopper portions 73, 74. Note, when any of the conductive terminals 100 is not fully inserted, the front end of the retainer 70 collides with the sheath 10 and the second engage portion 12, and thus the retainer 70 cannot be inserted up to the predetermined position. Hence, halfway insertion (inserting error) is detectable in view of this condition.

The first engage portion 11 protruding on the sheath 10 includes the inclined portion 11*a* that has a downward inclination toward the forward side, and the plane portion 11*c* which is provided continuously from the inclined portion 11*a* and which overlaps with the outer face of the ceiling wall 10*a*. The first engage portion 11 further includes the interconnecting portion 11*e* that interconnects the top portion 11*d*, the inclined portion 11*a*, the plane portion 11*c* with the side walls 10*c, d*. Hence, the exposed burr edge on the outside of the conductive terminal 100 formed during the punching work on the sheet metal is reduced, and thus a damage to the mat seal 50 when the conductive terminal 100 is inserted in the housing 400 is suppressed. In addition, when the conductive terminal 100 is inserted through the through-hole 51*a* of the mat seal cover 51 and the through-hole 50*a* of the mat seal 50, the inclined portion 11*a* serves as a wedge which facilitates the inserting work to the housing 400.

In addition, since the plane portion 11*c* overlaps with the outer face of the ceiling wall 10*a* of the sheath 10, and the top portion 11*d*, the inclined portion 11*a*, and the plane portion 11*c* are interconnected with the side wall 10*c* by the interconnecting portion 11*e*, the rigidity of the sheath 10 is enhanced. Thus a deformation of the ceiling wall 10*a* when an unillustrated male terminal fitting is inserted in the sheath 10 is suppressed. In addition, a reduction of the electrical contact reliability between the unillustrated male terminal fitting and the conductive terminal 100 is not likely to occur.

Still further, since the abutting portion 11*b* which extends from the backward side of the first engage portion 11 in the direction approaching the axial center 10*x*, and which abuts the outer face of the ceiling wall 10*a* of the sheath 10 is provided, a deformation of the ceiling wall 10*a* when the male terminal fitting is inserted in the sheath 10 is further suppressed. This is effective for improvement of the electrical contact reliability.

Likewise, the second engage portion 12 is provided with, from the forward side to the backward side, the abutting portion 12*b*, the top portion 12*d*, the inclined portion 12*a*, the plane portion 12*c*, the stopper portion 12*f*, and the interconnecting portion 12*e* that interconnects the top portion 12*d*, the inclined portion 12*a*, the plane portion 12*c* with the side walls 10*c*, 10*d* of the sheath 10.

In addition, a structure in which, the plane portion 12*c* overlaps with the outer face of the ceiling wall 10*a* of the sheath 10, and the top portion 12*d*, the inclined portion 12*a*, the plane portion 12*c* are continuous with the side wall 10*c* of the sheath 10 by the interconnecting portion 12*e* is accomplished. This enhances the rigidity of the backward side of the sheath 10, and a deformation of the ceiling wall 10*a* at the backward side of the sheath 10 when the male terminal fitting is inserted in the sheath 10 is also suppressed. This is effective for improvement of the electrical contact reliability. In addition, when the conductive terminal 100 that has been inserted in the terminal housing room 40 of the housing 400 is once removed (pulled out), since the inclined portion 12*a* serves as a wedge, the removal work is facilitated, preventing the mat seal 50 from being damaged.

Still further, since the abutting portion 12*b* provided so as to extend from the forward side of the second engage portion 12 in the direction approaching the axial center 10*x* of the sheath 10 abuts the outer face of the ceiling wall 10*a* of the sheath 10, a deformation of the ceiling wall 10*a* at the backward side of the sheath 10 when the male terminal fitting is inserted in the sheath 10 is further suppressed. This is effective for improvement of the electrical contact reliability.

As explained above, the conductive terminal 100 is formed by performing a bending work and a drawing work on the sheet metal material 90 having undergone a punching work already. In particular, the top portions 11*d*, 12*d*, the inclined portions 11*a*, 12*a*, and the plane portions 11*c*, 12*c* are formed by performing a drawing work on portions indicated by the arrows P of the sheath formation area 95 of the sheet metal material 90 which is to form the conductive terminal 100. Hence, the interconnecting portion 11*e* (12*e*) that interconnects the top portion 11*d* (12*d*), the inclined portion 11*a* (12*a*), the plane portion 11*c* (12*c*) with the side walls 10*c*, 10*d* of the sheath 10 can be easily formed, and the rigidities of the top portion 11*d* (12*d*), inclined portion 11*a* (12*a*), and plane portion 11*c* (12*c*) can be remarkably enhanced.

In addition, by performing a drawing work on the portions indicated by the arrows P illustrated in FIGS. 6 and 7 of the sheath formation area 95 of the sheet metal material 90, the top portions 11*d*, 12*d*, the inclined portions 11*a*, 12*a* and the plane portions 11*c*, 12*c* can be formed without a cutting work to the sheet metal material 90, and thus any burr edge is not formed. In addition, application of the drawing work enhances the rigidities of the top portions 11*d*, 12*d*, inclined portions 11*a*, 12*a*, and plane portions 11*c*, 12*c*.

Still further, according to the conductive terminal 100, the abutting portions 11*b*, 12*b* and the stopper portion 12*f* are formed by performing a bending work on the protruding portions 91, 92 and the protruding portion 93 illustrated in FIGS. 6 and 7 that are portions of the sheath formation area 95 of the sheet metal material 90 extended in parallel with the fitting direction X. By applying such a work in this manner, the abutting portions 11*b*, 12*b* can be formed without forming a burr edge, thus it is effective for preventing the mat seal 50 from being damaged.

Note, the conductive terminal 100 explained with reference to FIGS. 1-13 is merely an example of the present disclosure, and the conductive terminal according to the present disclosure is not limited to the foregoing conductive terminal 100.

For example, the conductive terminal 100 may have only one of the first engage portion 11 and the second engage portion 12. The positions of the first and second engage portions 11 and 12 are not limited. For example, one of the first and second engage portions 11 and 12 may be formed at the center portion of the sheath 10.

The shape of the sheath 10 is not limited to the rectangular cylindrical structure. It may be, for example, a round like cylindrical structure.

The means for connecting the conductive terminal 100 and wire 60 is arbitrarily selected. For example, the conductive terminal 100 and core wire 62 may be connected by soldering.

The structure of the retainer 70 is not limited to the embodiments. The structure of the retainer 70 is arbitrarily selected so as to engage with the first and second engaging portions 11 and 12 and retain the conductive terminal 100.

In the embodiments, the seal member comprised of the mat seal 50 and mat seal cover 51. The structure of the seal member is arbitrarily selected.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A conductive female terminal comprising:

a cylindrical main body formed of a conductor, and formed with a first opening in which a male terminal is to be inserted; and a first protrusion formed of a conductor, and formed so as to protrude from the main body in a direction becoming apart from an axial center of the main body, wherein the first protrusion includes:

a first inclined portion inclined so as to approach the axial center of the main body toward the first opening;

a first plane portion extending from the first inclined portion toward the first opening, and disposed so as to overlap with the main body; and a first interconnecting portion that interconnects the first inclined portion with the main body.

2. The conductive female terminal according to claim 1, wherein the first protrusion further comprises a first abutting portion extending from the first inclined portion in the direction approaching the axial center of the main body, and abutting the main body.

3. The conductive female terminal according to claim 1, further being formed with a second opening located on the opposite side to the first opening, and further comprising a second protrusion formed, at the second opening side relative to the first protrusion, so as to protrude from the main body in the direction becoming apart from the axial center of the main body, wherein the second protrusion includes:

a second inclined portion inclined so as to approach the axial center of the main body toward the second opening;

a second plane portion extending from the second inclined portion toward the second opening, and disposed so as to overlap with the main body; and a second interconnecting portion that interconnects the second inclined portion with the main body.

4. The conductive female terminal according to claim 2, further being formed with a second opening located on the opposite side to the first opening, and further comprising a second protrusion formed, at the second opening side relative to the first protrusion, so as to protrude from the main body in the direction becoming apart from the axial center of the main body, wherein the second protrusion includes:

a second inclined portion inclined so as to approach the axial center of the main body toward the second opening;

a second plane portion extending from the second inclined portion toward the second opening, and disposed so as to overlap with the main body; and a second interconnecting portion that interconnects the second inclined portion with the main body.

5. The conductive female terminal according to claim 3, wherein the second protrusion further comprises a second abutting portion extending from the second inclined portion in the direction approaching the axial center of the main body, and abutting the main body.

6. The conductive female terminal according to claim 4, wherein the second protrusion further comprises a second abutting portion extending from the second inclined portion in the direction approaching the axial center of the main body, and abutting the main body.

7. The conductive female terminal according to claim 1, further comprising a connection portion formed of a conductor, extending from the main body and connected with a wire.

8. A connector comprising:

a housing formed with a plurality of terminal housing rooms disposed in a matrix, and comprises a plurality of lances each protruding in the terminal housing rooms; and a plurality of the conductive female terminals, wherein each conductive female terminal includes:

a cylindrical main body formed of a conductor, and formed with a first opening in which a male terminal is to be inserted; and a first protrusion formed of a conductor, and formed so as to protrude from the main body in a direction becoming apart from an axial center of the main body, wherein the first protrusion includes a first inclined portion inclined so as to approach the axial center of the main body toward the first opening, a first plane portion extending from the first inclined portion toward the first opening and being disposed so as to overlap with the main body, and a first interconnecting portion that interconnects the first inclined portion with the main body, wherein the conductive female terminals are each inserted in the terminal housing rooms, and each fixed in the terminal housing rooms because the first protrusion of the conductive female terminal is engaged with the lance.

9. The connector according to claim 8, wherein the first protrusion further comprises a first abutting portion extending from the first inclined portion in the direction approaching the axial center of the main body, and abutting the main body.

10. The connector according to claim 8, each female conductive terminal being formed with a second opening located on the opposite side to the first opening, and further comprising a second protrusion formed, at the second opening side relative to the first protrusion, so as to protrude from the main body in the direction becoming apart from the axial center of the main body, wherein the second protrusion includes:

a second inclined portion inclined so as to approach the axial center of the main body toward the second opening;

a second plane portion extending from the second inclined portion toward the second opening, and disposed so as to overlap with the main body; and a second interconnecting portion that interconnects the second inclined portion with the main body.

11. The connector according to claim 9, each female conductive terminal being formed with a second opening located on the opposite side to the first opening, and further comprising a second protrusion formed, at the second opening side relative to the first protrusion, so as to protrude from the main body in the direction becoming apart from the axial center of the main body, wherein the second protrusion includes:

a second inclined portion inclined so as to approach the axial center of the main body toward the second opening;

a second plane portion extending from the second inclined portion toward the second opening, and disposed so as to overlap with the main body; and a second interconnecting portion that interconnects the second inclined portion with the main body.

12. The connector according to claim 10, wherein the second protrusion further comprises a second abutting portion extending from the second inclined portion in the direction approaching the axial center of the main body, and abutting the main body.

13. The connector according to claim 11, wherein the second protrusion further comprises a second abutting portion extending from the second inclined portion in the direction approaching the axial center of the main body, and abutting the main body.

14. The connector according to claim 8, each conductive female terminal further comprising a connection portion formed of a conductor, extending from the main body and connected with a wire.

15. A method of manufacturing a conductive female terminal, the method comprising:

preparing a basal plate that comprises a conductive sheet and a conductive portion provided at a side of the conductive sheet so as to extend from the side thereof;

shaping the conductive portion in a concave shape;

shaping the conductive sheet cylindrically so as to cause the conductive portion shaped concavely to extend in a circumferential direction of the conductive sheet shaped cylindrically; and providing the conductive portion shaped concavely so as to be putted on the conductive sheet shaped cylindrically.

16. The conductive female terminal manufacturing method according to claim 15, further comprising: making a portion of the conductive portion shaped concavely to abut the conductive sheet shaped cylindrically.

* * * * *